United States Patent [19]

Terzi

[11] Patent Number: 4,790,444

[45] Date of Patent: Dec. 13, 1988

[54] CUP-CAP COMBINATION FOR SOFT DRINK CANS

[75] Inventor: Dario Terzi, Sarnico, Italy

[73] Assignee: Terzi Stampi S.n.c.di Dario Terzi & C., Italy

[21] Appl. No.: 100,111

[22] Filed: Sep. 23, 1987

[30] Foreign Application Priority Data

Nov. 27, 1986 [IT] Italy ..... 5250 A/86
Jul. 7, 1987 [IT] Italy ..... 5206 A/87

[51] Int. Cl.[4] ..... A47E 19/22
[52] U.S. Cl. ..... 220/90.2; 220/90.6; 222/192
[58] Field of Search ..... 220/90.2, 90.6, 855 P; 222/192, 542, 570

[56] References Cited

U.S. PATENT DOCUMENTS 4,579,257 4/1986 Brandlein ..... 220/90.2

*Primary Examiner*—George T. Hall
*Attorney, Agent, or Firm*—McGlew and Tuttle

[57] ABSTRACT

A cup-like container, doubling as a sealing cap is disclosed for application to cans for soft drinks and the like. The cup-cap combination consists of a cup element rotatably mounted, directly of indirectly, on the rim of the can's lid and having a base aperture that can be positioned in juxtaposition with the opening in the lid, so as to allow the pouring of the contents, or away from said opening, so as to seal the can and prevent the spillage of the liquid. The cup element, thus, permits the consumption of the contents without resting one's lips on the rim of the can and allows the preservation of the contents, once the can has been opened.

7 Claims, 3 Drawing Sheets

CUP-CAP COMBINATION FOR SOFT DRINK CANS

FIELD OF THE INVENTION

The present invention is directed to a cup-like container which doubles as a cap-like closure to be applied on the lid of cans for soft drinks and the like, so as to permit the drinking of the liquid without touching the can's lid itself and to allow the closing of the opened can to preserve the liquid contained therein.

BACKGROUND OF THE INVENTION

Generally, the contents of a can, such as a soft drink or beer, are poured and consumed through an opening that is formed in the lid of the can by pulling on an opening tongue or pressing on a specified area of the lid. In certain types of cans, the opening tongue may be removed from the lid by a simple yanking motion; in other types, the tongue remains attached to the lid and the opening for the removal of the liquid is obtained by pressing with the tongue itself on the diaphragm provided on the lid. In any event, when the contents are poured into a separate container, such as a glass, the liquid runs along a portion of the can's rim. When, on the other hand, the liquid is drunk and consumed directly from the can, it is usually necessary to rest one's lips on the can's rim. In view of the various treatments and handlings of a can, it is obvious that its body and, particularly, its rim is not in the best conditions of cleanliness and hygiene for allowing the liquid to run thereover or for resting one's lips thereagainst without danger of contacting microbs or bacteria.

At the present state of the art, therefore, nothing has been proposed that allows one to drink directly the contents of a can without having to contact one's lips with the can's rim or causing the liquid to run along the rim.

BRIEF DESCRIPTION OF THE INVENTION

It is, therefore, one object of the present invention to provide a cup-like container to be snapped onto the rim of a can, once the can has been opened, so as to allow the consumption of the liquid without resting one's lips directly on the can's rim and without causing the liquid to run along the rim itself, thus preserving the highest hygienic conditions.

It is another object of the invention to provide a cup-like container applicable onto a can's rim and capable of serving also as cap-like closure for the can, once this has been opened, so as to preserve the liquid contained in the can, avoid the introduction of extraneous matter in the can and prevent the spilling of the contents in the event of an accidental upsetting of the can.

Thus, the cup-like container of the invention can serve a dual purpose, that is, it can insure the consumption of the liquid contents under the highest hygienic conditions and it can afford a correct preservation of the liquid while the can is open.

As stated above, the can may be of the type wherein the opening tongue remains attached to the lid after the can has been opened, in which case the cup-like container comprises substantially (a) a fixed hood that can be snapped on the can and has a mouthpiece in correspondence of the opening in the can's lid and (b) a cup-like element rotatably mounted on the hood and having a base aperture that may be juxtaposed with the mouthpiece of the hood when the contents are to be poured, or it may be spaced from the mouthpiece of the hood when the lid is to be sealed and the contents preserved in the can.

Alternately, the can may be of the type wherein the opening tongue can be snapped off completely, in which case the cup-like element simply comprises a body having radial means that face toward the center for engagement, through a direct snapping action, with the can's rim and a base wall that has at least one aperture positionable in juxtaposition with or away from the opening on the can's lid, the base wall having, further, on its lower surface a number of annular or radial ribs for sealably engaging the upper surface of the lid, regardless of whether the aperture of the base wall is in juxtaposition with or away from the opening in the can's lid.

THE DRAWINGS:

Greater details of the invention will become apparent from the following description of the embodiments thereof, with reference to the accompanying drawings, in which.

DETAILED DESCRIPTION OF THE INVENTION

Figure 1:
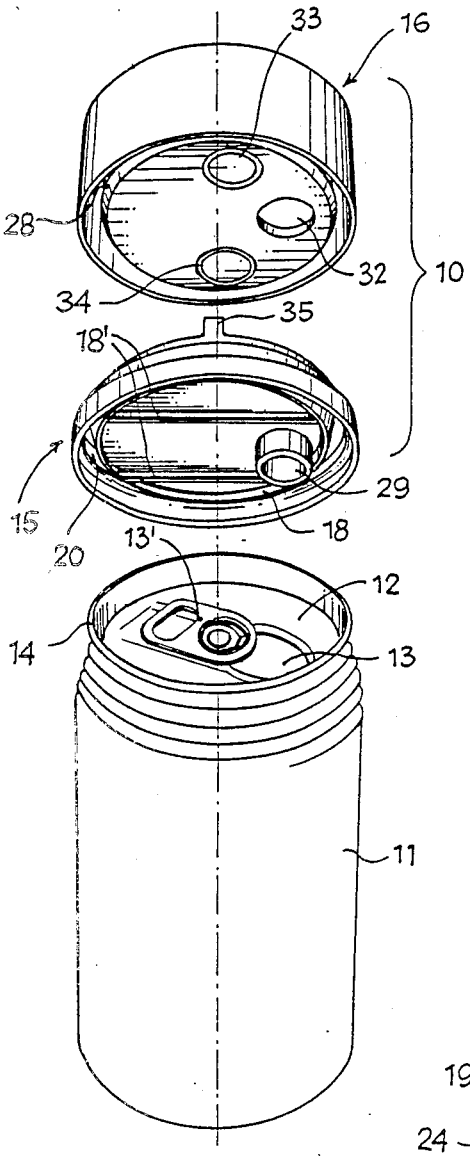
FIG. 1 is a perspective view of a typical can and of the elements constituting the cup-like element.
Figure 3:
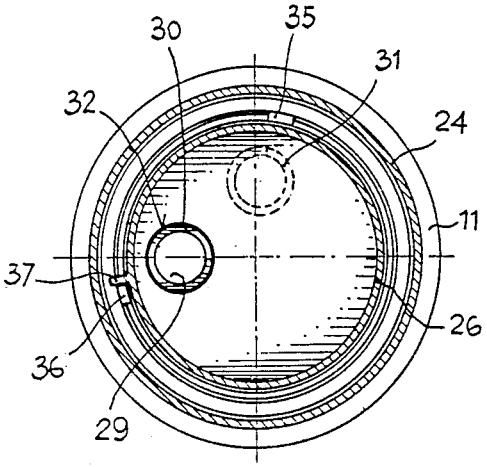
FIG. 3 is a horizontal, sectional view taken along lines III—III of FIG. 2.

The cup-like container or element (hereinafter referred to simply as the cup element) of the invention is represented by the numeral 10 and it is applicable to cans for soft drinks and the like 11, which are provided, as it is well known, with a lid 12. The lid has an opening 13 for pouring the liquid contents of the can and a peripheral rim 14, the opening 13 being defined by a tongue 13' which is either removable from or fixedly attached to the lid.

In the embodiment of the invention illustrated by FIGS. 1–5, the cup 10 consists of two elements or members made usually from plastic material: specifically, a base hood 15 and the cup element proper 16.

The hood 15 is provided with a horizontal wall 17, on the lower surface of which there are an annular rib 18 and a plurality of transverse ribs 18', which have the function of resting against the lid of the can.

Peripherically and concentrically to the rib 18, the horizontal wall 17 is provided with an annular portion 19 that extends downwardly and carries on its inside an annular protrusion 20. This protrusion 20 may be continuous or not and serves the purpose of engaging, by means of a snapping action, the rim 14 of the can. The peripheric portion 19 joins the horizontal wall 17, and more precisely the annular rib 18, by means of a V-shaped flange 19', which defines toward the outside thereof a step 21 and affords to said peripherical annular portion 19 some degree of flexibility and elasticity, so that it may snappingly engage the rim 14 of the can and allow the ribs 18–18' to properly rest against the lid 12.

On the opposite surface of the horizontal wall 17 of the hood 15, there is provided an upper annular wall 22, which similarly has, on the inside thereof, an annular protrusion 23 for engaging and retaining the cup element 16.

Cup element 16 comprises an outer wall 24 which is connected in its upper part, at 25, to an inner concentric wall 26. Wall 26 is in turn integrally attached to a base wall 27. The lower extremity 24' of the outer wall 24 joins the peripheral step 21 of the base hood, while on the outer surface of the inner wall 26 there is provided an annular shoulder 28 which serves to interact with the engaging protrusion 23 of the upper wall 22 of the hood 15. The hood 15 and the element or member 16 are to be assembled together —see FIG. 2—and, when the cup is in use, the hood 15 rests against the lid 12 of the can and is engaged to the rim 14, thanks to the engaging protrusion 20. The hood 15 is, thus, attached and cannot rotate freely. In turn, the cup element 16 engages the hood 15, so as to become axially attached thereto, but may be rotated with respect to the hood itself.

On the horizontal wall 17 of the hood 15 there is provided a mouthpiece 29 to be inserted in the opening 13 of the lid 12 of the can. On the upper surface of this wall 17 are also provided a first annular rib 30 which surrounds the mouthpiece 29 and, angularly spaced from the first rib, a second annular rib 31. On the base wall 27 of the cup element 16 there is provided an aperture 32 which may be positioned in correspondence of the mouthpiece 29 or may be moved away from it, as a result of a rotation of the cup element itself. On the lower surface of the base wall 27 of the cup element 16 there are provided two annular sockets 33–34, symmetrically placed with respect to the aperture 32 and having a diameter equal to that of the annular ribs 30–31 of the hood 15. The annular sockets 33–34 cooperate with the annular ribs 30–31, so as to define the positions in which the aperture 32 is either in juxtaposition with the mouthpiece 29 or away from it. These positions could, however, be defined by stop means provided on the hood 15 and on the cup element 16, such as, for instance, a pair of pegs 35-36 (on the hood) cooperating with a rabbet 37 (on the cup element).

It is evident that, when the base aperture 32 is in juxtaposition with the mouthpiece 29 of the hood 15, it is possible to pour the contents of the can or to drink directly the liquid by resting one's lips against the rim 25 of the cup element 16. Conversely, when the aperture 32 is moved away from the mouthpiece 29, the assembled device serves as a cap for closing the can, so as to preserve the liquid contained therein and, concurrently, prevent the accidental spilling of the contents from the can.

Figure 2:
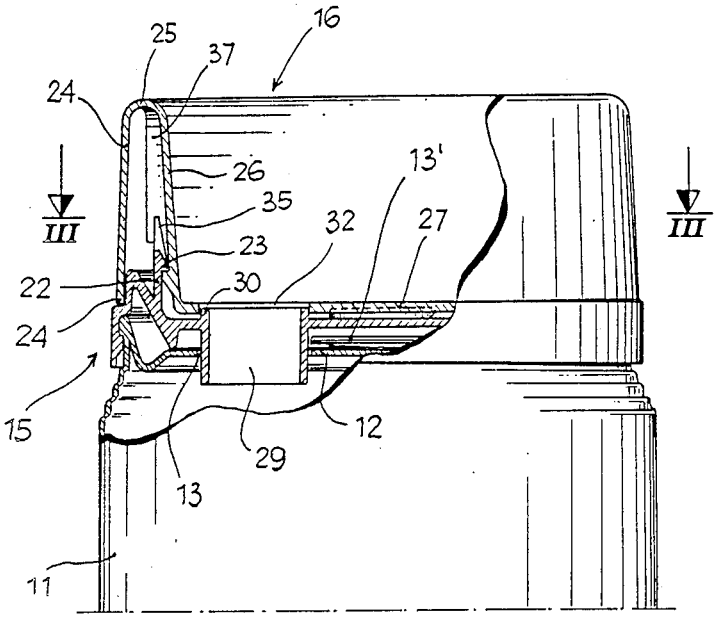
FIG. 2 is a partial, sectional, enlarged view of the cup-like element, assembled and applied to the can.
Figure 4:
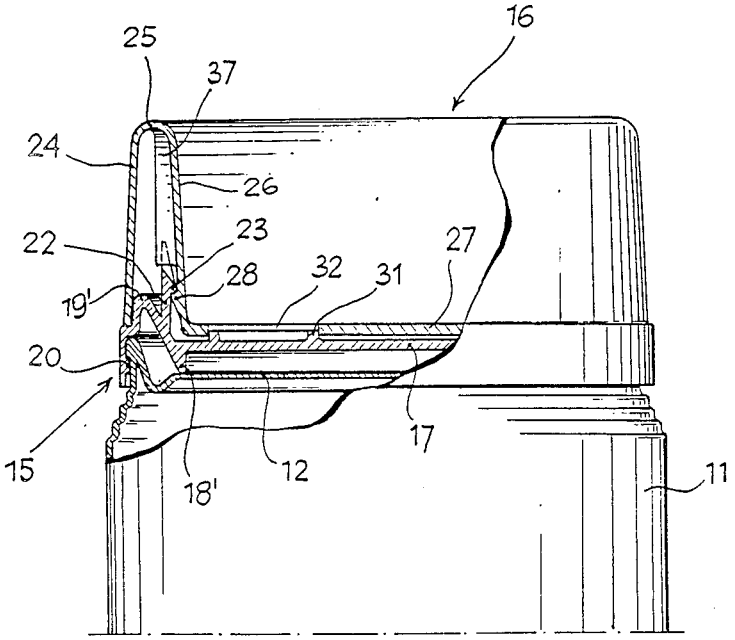
FIG. 4 is a radial, sectional view of the cup-like element in the closed position.

According to the embodiment illustrated in FIGS. 2 and 4 of the accompanying drawings, when the aperture 32 is in juxtaposition with the mouthpiece 29, the annular rib 30 which surrounds the mouthpiece 29, interacts with the rim of the aperture 32, so as to obtain a seal that prevents the passage of the liquid between the two elements 15-16, while the second annular rib 31 settles in an annular cavity 33 beneath the base of the cup element 16.

When, subsequently, the aperture 32 is moved away from the mouthpiece 29, it is the second annular rib 31 that engages the aperture 32—see FIG. 4—, while the annular rib 30, which surrounds the mouthpiece 29, settles in the annular cavity 34 beneath the base of the cup element 16.

Figure 5:
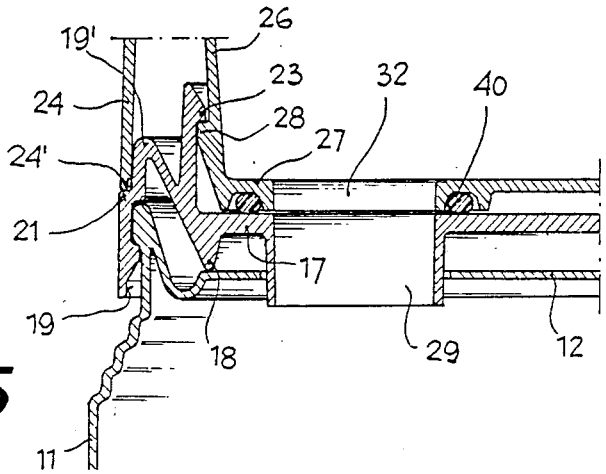
FIG. 5 is a sectional view corresponding to FIG. 2, but relating to a variant in the sealing means.

Alternately, and also for obtaining a better seal, on the lower surface of the base wall 27 of the cup element 16, there is mounted within a suitable seat —see FIG. 5—an annular gasket 40, which surrounds the aperture 32 and rests against the upper surface of the horizontal wall 17 of the hood 15, about the mouthpiece 29 when the aperture 32 is in juxtaposition with the mouthpiece, and elsewhere when the aperture 32 is away from the mouthpiece 29.

Figure 6:
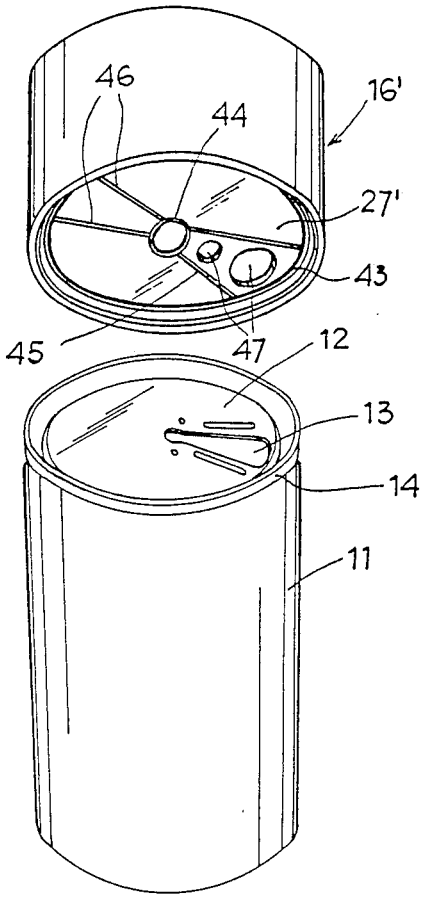
FIG. 6 is a view representing a variant in the construction of the cup-like element, that is, relating to a can with tongue removable through a snapping action.
Figure 7:
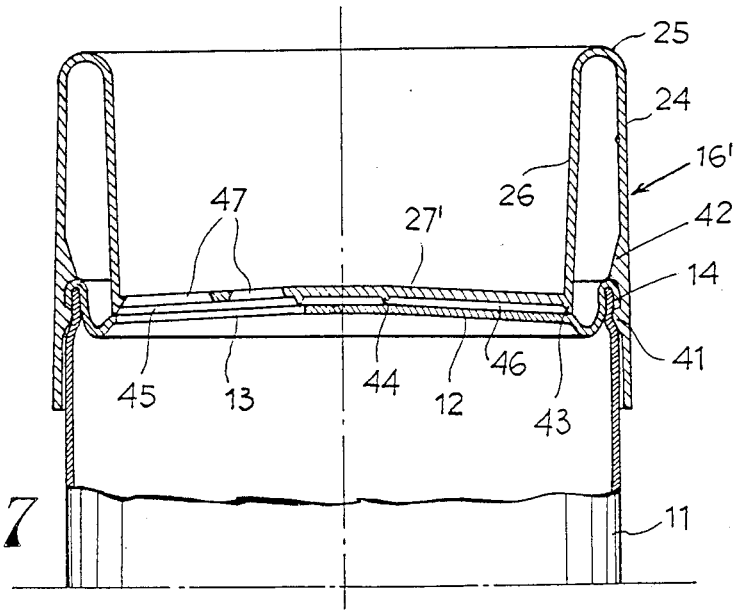
FIG. 7 is a sectional view of the cup-like element of FIG. 6, as it is applied to the can.

According to the variant illustrated in FIGS. 6 and 7 of the drawings, the hood 15 is eliminated and the cup element 16' is rotatingly applied directly to the rim 14 of the can. More specifically, the outer wall 24' of the cup 16' extends downwardly, below the base 27' and displays, on its inner surface, an annular protrusion 41 and optionally a plurality of radial teeth or shoulders 42 coplanar among themselves, The annular protrusion 41 is positioned at such level as to engage peripherically, when the cup is applied to the can, beneath the rim 14 of the can, while the teeth or shoulders 42 are positioned on a higher level, so as to engage in turn the rim 14 of the can in opposition to the protrusion 41.

The base 27' of the cup 16' is provided with at least an aperture 47 which can be placed in juxtaposition with or away from the opening 13 in the lid 12 of the can, as a result of the rotation of the cup with respect to the can.

On the lower surface of the base 27' of the cup 16', there are provided two annular and concentric ribs 43–44 and, between these ribs, a plurality of radial ribs 45–46, each rib having a wedge-like section with the apex facing downwardly to serve as retaining means.

Of the two annular and concentric ribs 43–44, the first, facing outwardly,—see FIG. 7—, has the purpose of resting (with sealing action) against the lid 12 of the can in correspondence of a circumference passing on the outside of the opening 13. The second annular and concentric rib 44, instead, rests (with sealing action) against the lid 12 of the can in correspondence of a circumference centrally displaced with respect to the opening 13. At least two of the radial ribs 45 are positioned on opposed sides of the aperture 47 of the base of the cup, while the rest of the radial ribs 46 are spaced from or diametrically opposed to one another. The ribs 45 are on opposed sides from the opening 13 of the lid 12 when the base aperture 47 of the cup is in juxtaposition with the opening 13.

When it is applied to the rim 14 of the can, the cup may be rotated with respect to the can, so as to position its base aperture 47 in juxtaposition with or away from the opening 13 of the lid 12.

In the first case, the two radial ribs 45 and those portions of the annular ribs 43–44 comprised between the said radial ribs achieve the sealing of the fluid on the perimeter of the opening 13 of the lid. In the second case, instead, that is, when the baee aperture 47 of the cup is spaced away from the opening 13 of the can, the cup acts as a cap for sealing the liquid in the can and preventing its spilling therefrom. It is, in this case, the radial ribs 46 that insure, in combination with the annular ribs 22–23, the sealing of the lid.

What is claimed is:

1. Cup-cap combination applicable to the rim of cans for soft drinks and the like, for pouring or consuming the contents without directly touching the rim, the can having a lid with an opening therein, characterized in that it consists of (a) a base hood fixedly mounted on said rim and having a mouthpiece in juxtaposition with said opening and (b) a cup element rotatably mounted on said hood and having a base aperture positionable in juxtaposition with said mouthpiece for sealing said can.

2. Cup-cap combination according to claim 1, wherein said hood comprises (a) a horizontal wall for resting against said lid by means of lower ribs, (b) first peripherical means for engaging said rim and (c) second peripherical means positioned above said first peripherical means for rotatably engaging said cup element; said hood having a horizontal wall containing said mouthpiece; said cup element having a base wall superimposed parallel to said horizontal wall of said hood and containing said aperture; said base aperture being positionable in juxtaposition with or away from said mouthpiece.

3. Cup-cap combination according to claim 2, wherein between said hood and said cup element there are provided means for limiting the rotation of said cup element and positioning said base aperture in juxtaposition with or away from said mouthpiece.

4. Cup-cap combination according to claim 2, wherein between said horizontal wall of said hood and said base wall of said cup element there are provided sealing means at least between said mouthpiece and said base aperture when said mouthpiece and said base aperture are in juxtaposition with respect to each other.

5. Cup-cap combination according to claim 4, wherein said sealing means consist of at least one annular rib surrounding said mouthpiece and resting against the lower surface of said base wall of said cup element of against the rim of said base aperture of said cup element.

6. Cup-cap combination according to claim 4, wherein said sealing means are an elastic flexible gasket surrounding said base aperture of said cup element and resting against the upper surface of said horizontal wall of said hood.

7. Cup-cap combination applicable to the rim of cans for soft drinks and the like, for pouring or consuming contents without directly touching the rim, the can having a lid with an opening therein, said cup-cap having a body with engaging radial means facing inwardly toward the center and serving to engage, through a snapping action, said rim, and with a base wall having at least one aperture positionable in juxtaposition with or away from said opening; said base wall having on its lower surface a plurality of annular and radial ribs resting, always with sealing action, against the upper surface of said lid of said can, said lower surface of said base wall having a pair of annular concentric ribs and a plurality of radial ribs resting with sealing action against said lid of said can; said two annular concentric ribs being positioned on circumferences passing, respectively, outside and inside of said opening in said lid; two of said plurality of radial ribs being on opposite sides of said base aperture of said cup element.

* * * * *